United States Patent [19]

Stracke

[11] Patent Number: 4,831,801

[45] Date of Patent: May 23, 1989

[54] PROCESS FOR MANUFACTURING CONSTRUCTION ELEMENTS, THEIR COMPOSITION, REINFORCEMENT AND MEANS FOR MOUNTING SAME

[76] Inventor: Markus Stracke, Schmidtgasse 4, 1010 Vienna, Austria

[21] Appl. No.: 49,978

[22] PCT Filed: Aug. 12, 1986

[86] PCT No.: PCT/AT86/00044

§ 371 Date: Mar. 30, 1987

§ 102(e) Date: Mar. 30, 1987

[87] PCT Pub. No.: WO88/01329

PCT Pub. Date: Feb. 25, 1988

[30] Foreign Application Priority Data

Jun. 3, 1985 [AU] Australia ..... A 1675/85

[51] Int. Cl.[4] ..... E04C 1/10; E04B 2/72

[52] U.S. Cl. ..... 52/309.1; 52/487; 52/714; 52/763; 52/745

[58] Field of Search ..... 52/426, 428, 486, 487, 52/506, 509, 513, 745, 562–565, 712–714, 747, 309.1

[56] References Cited

U.S. PATENT DOCUMENTS

| | | | |
|---|---|---|---|
| 1,798,331 | 3/1931 | Liptak | 52/487 X |
| 2,304,333 | 12/1942 | Bossi | 52/509 |
| 2,847,849 | 8/1958 | Reintjes | 52/487 X |
| 3,181,278 | 5/1965 | Jones | 52/509 X |
| 3,378,969 | 4/1968 | Larger | 52/487 X |
| 3,559,358 | 2/1971 | Lohse et al. | 52/714 X |
| 3,939,619 | 2/1976 | Mason | 52/714 X |
| 4,258,522 | 3/1981 | Amaral | 52/309.1 X |
| 4,700,527 | 10/1987 | Pardo | 52/763 |

FOREIGN PATENT DOCUMENTS

| | | | |
|---|---|---|---|
| 664199 | 1/1952 | United Kingdom | 52/509 |

*Primary Examiner*—David A. Scherbel
*Assistant Examiner*—Richard E. Chilcot, Jr.
*Attorney, Agent, or Firm*—Herbert Dubno

[57] ABSTRACT

A construction element adapted to be fixed to the facade of a building is produced by hardening a composition consisting essentially of foamed synthetic material with a particle size of 2 mm to 7 mm, cement and water and of a bulk density of 0.2 to 0.4 kg/dm$^2$ and a thermal conductivity of 0.06 to 0.08 w/mh° K. Mounting clips are driven into the body to enable it to be attached to the building facade.

2 Claims, 2 Drawing Sheets

PROCESS FOR MANUFACTURING CONSTRUCTION ELEMENTS, THEIR COMPOSITION, REINFORCEMENT AND MEANS FOR MOUNTING SAME

CROSS-REFERENCE TO RELATED APPLICATION

This application is a National Phase application of PCT/AT 8600044 filed Aug. 12, 1986 and based, in turn, upon an Austrian national application No. 1675/85 filed June 3, 1985.

It is known to manufacture building elements for facades, as cornices made of wood, bricks of heavy concrete, plaster (lime-cement mortar) or hardened plastic foams, whereby some of the aforementioned can be prefabricated.

As far as mounting of these elements to finished buildings is concerned, the above-mentioned systems are often avoided.

For example, dimensions of wood elements are greatly influenced by humidity variations, bricks are not very appropriate for safe fastening of cornices to finished buildings, cornice or frame parts made of heavy concrete can not always be securely fastened to old buildings, due to their specific weight, facade elements made of plaster are limited as to their size is concerned, profile elements made of polystyrene are not solid facade ornaments. Therefore, it is clear that facade elements to be mounted on completed buildings, either as cornices or as ornamental blocks or the like, are problematic. Furthermore, since not all cornice parts are thermoinsulating, particularly at the ceiling levels of each floor which mostly represent cold bridges, these cornice parts have to be made thermoinsulating.

SUMMARY OF THE INVENTION

According to the invention, the aforementioned facade elements are made of a mass consisting mostly of foamed synthetic materials, with a particle size of 2 mm to 7 mm and a small part of cement and water to bulk densities of 0.2 to 0.4 kg/dm$^3$. The physical characteristics of this mass are surprisingly good, for instance it is not rough, it is frost-resistant, fireproof, easy to work on and extremely thermoinsulating. The thermal conductivity coefficient is Lamda b=0.06 to 0.08 w/mh° K.

Surprisingly, it has been found that the described mass can be shaped with rotating profiled plates, and that the reinforcement anchors can be driven into the already finished profiled body at any desired point, as deeply as desired, without precutting, so that the cumbersome prepositioning of reinforcement anchors in forms can be eliminated. Due to the low specific weight, profiled bodies with large volumes, for instance with a length of 1.5 m, a projection of 0.4 m and a height of 0.3 m can be affixed after building to the outer walls and screwed to the wall by means of anchoring clips. The manufacture of the profiled facade elements can be done so that the mentioned lightweight concrete mass can be formed, and on the next day after hardening, the unfashioned facade element is passed through a shaping device. The direction of advance follows a curved path in the case of arched cornice elements.

Because of the workability of the blanks, the shaping device can work according to a very simple principle.

One or more horizontal shafts can be provided each with a longitudinal slot passing through their middle, whereby the respective profiled plate with a thickness of 4 mm, presenting outer contours as a mirror image is passed through and centrally fastened in the longitudinal slot, which has a length of for instance 1 m and a thickness of 4 mm. The shaping shaft, which turns in a direction opposite to the direction of displacement of the blank is oscillatingly supported in both bearings by suspension spindles, so that besides the horizontal back- and forth motion of the shaft, it is also possible to move it up and down, as well as to tilt in any desired way, for the purpose of positioning. After the positioning of the shaping shaft, each bearing bracket is fastened to the vertical support structure. The setting for the manufacture of different profiles, after the insertion of the pattern plate provided therefor, is in this case unusually quick and does not require large expenses.

The facade elements according to the invention can be shaped at any desired point, whereby it is possible to effect shaping not only on the visible side, but also at the upper side and the back side of the elements. On the upper face of the construction element, little grooves are cut out, which serve for the subsequent filling with heavy concrete and for receiving reinforcement bars, which are thereby protected against rust. These steel concrete reinforcements connect several shaped bodies to each other, and also serve to increase the strength of the material so it is safe to tread upon, or to serve for the formation of bearing pressure points, for instance wherever the anchors are to be fastened or are already fastened, or for instance where handrails are to be mounted.

On the side of the profiled body facing the building, fine grooves for receiving of larger amounts of adhesive mortar can be precut. The projecting facade element parts are either arranged side by side flush with each other, or mounted one after the other via offset lateral flanks, or dovetailed or toothed lateral flanks. The fastening anchors are preferably manufactured of bent flat steel bars, whereby these bars and/or claws thereon are subsequently driven into the light concrete mass, whereby these anchors consist preferably of two parts, whereby one the parts absorbs the vertical forces and the second part the horizontal forces resulting from the torque. The second part surrounds the vertical anchor at its upper portion, so that the vertical tongue can not move laterally, nor back and forth. The horizontal tongues can also be executed in such a way as to surround a steel concrete armature of the shaped element.

The groove-like recesses can run parallel to the facade wall. Channels running transversely or diagonally can also be cut into the element, and because of the work ability of the material, this cutting can also be done subsequently on site and this way special static requirements can be met.

The mentioned fashioned facade elements can be coated in a manner known per se, reinforced by reticular structures, or covered with sheet metal on top, for protection against heavy rain.

BRIEF DESCRIPTION OF THE DRAWING

The invention is now further detailed with the aid of the drawing, which.

SPECIFIC DESCRIPTION

Figure 1:
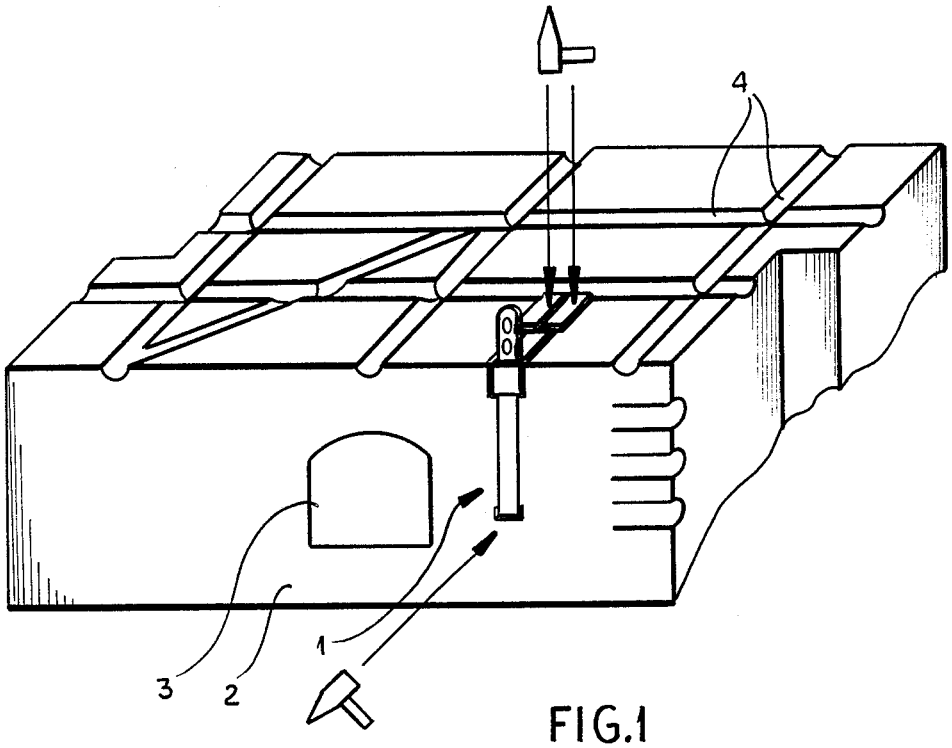
FIG. 1 is a fragmentary perspective view of a construction element according to the invention.
Figure 2:
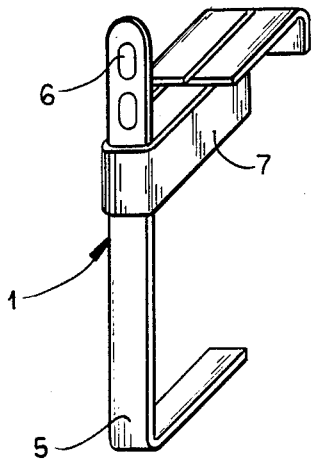
FIG. 2 is a perspective view of a reinforcement anchor.

The construction element 2 consists of a hardened mixture of a foamed synthetic material and cement, and, for reasons of weight reduction, has recesses 3 and on one side grooves 4, which can be cut after the hardening of the mass. These can be filled with concrete for the purpose of reinforcing the construction element 2. Hence, it is also possible to insert a reinforcement extending over several such construction elements. For the fastening of the construction element 2, a fastening anchor 1 can be driven thereinto with a hammer.

This fastening anchor 1 has an anchor base 5, which has at its upper end holes 6 for receiving the fastening screws. This anchor base 5 is connected with a tension rod 7, provided with claws which can be driven into the construction element 2, where this traction rod preferably reaches with its claws into the grooves 4, provided for the reinforcement of the construction element 2.

Figure 3:
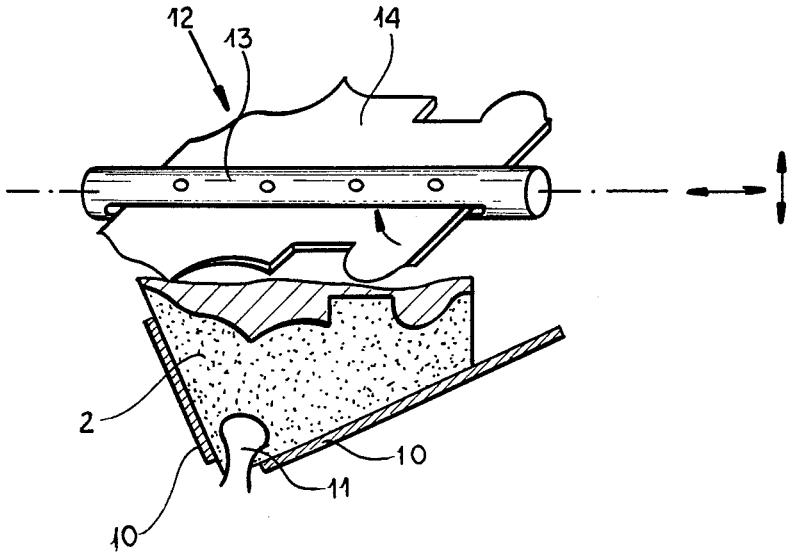
FIG. 3 is a diagrammatic perspective view of a shaping device for shaping of construction elements.

FIG. 3 shows a construction element 2 lying in a guide 10 movable by means of a slide pusher 11. This construction element is fashioned with the cutter 12. This cutter consists of a slotted shaft 13, wherein a pattern plate 14 is held. This pattern plate is not subjected to special stresses, since the construction elements are relatively soft.

I claim:

1. A method of making a construction element adapted to be applied to a facade of a building, comprising the steps of:

(a) forming a blank by hardening a composition consisting essentially of foamed synthetic material with a particle size of 2 mm to 7 mm, cement and water to a bulk density of 0.2 to 0.4 kg/dm$^2$ and a thermal conductivity of 0.06 to 0.08 w/mh° K.;

(b) shaping said blank by displacing said blank past a rotating shaft provided with a contoured plate removing material from said blank to form contours in said blank complementary to that of said contoured plate; and (c) driving into said blank after contouring thereof in step (b) an anchoring clip enabling mounting of the contoured blank on a facade of a building.

2. A construction element adapted to be applied to a facade of a building comprising a contoured body of a hardened composition consisting essentially of foamed synthetic material with a particle size of 2 mm to 7 mm, cement and water and of a bulk density of 0.2 to 0.4 kg/dm$^2$ and a thermal conductivity of 0.06 to 0.08 w/mh° K., and a clip driven into and anchored in said body enabling mounting of the contoured body on a facade of a building.

* * * * *